US008603063B2

(12) United States Patent
Grimm

(10) Patent No.: US 8,603,063 B2
(45) Date of Patent: Dec. 10, 2013

(54) MULTILAYER PLASTIC CONTAINER AND METHOD OF STORING LYOPHILIZED PRODUCTS

(75) Inventor: Michael J. Grimm, Sylvania, OH (US)

(73) Assignee: Rexam Healthcare Packaging Inc., Perrysburg, OH (US)

( * ) Notice: Subject to any disclaimer, the term of this patent is extended or adjusted under 35 U.S.C. 154(b) by 512 days.

(21) Appl. No.: 12/791,229

(22) Filed: Jun. 1, 2010

(65) Prior Publication Data

US 2010/0236090 A1 Sep. 23, 2010

Related U.S. Application Data

(62) Division of application No. 11/888,549, filed on Aug. 1, 2007, now abandoned.

(51) Int. Cl.

| | |
|---|---|
| ***A61B 19/00*** | (2006.01) |
| ***A61J 1/00*** | (2006.01) |
| ***F26B 5/04*** | (2006.01) |
| ***F26B 5/06*** | (2006.01) |

(52) U.S. Cl.
USPC ..... 604/408; 604/403; 604/415; 604/416; 34/282; 34/284; 34/287; 34/294

(58) Field of Classification Search
USPC ..... 604/403, 404, 407, 408, 409, 410, 415, 604/416; 34/282, 284, 285, 286, 287, 296; 220/58, 62.11, 62.22, 626, 415, 450; 206/504; 428/35.7
See application file for complete search history.

(56) References Cited

U.S. PATENT DOCUMENTS

| | | | | |
|---|---|---|---|---|
| 2,283,867 | A | 12/1939 | Flosdorf et al. | |
| 3,293,773 | A * | 12/1966 | Frazer et al. | 34/92 |
| 3,423,231 | A | 1/1969 | Lutzman | |
| 3,474,543 | A * | 10/1969 | Thompson et al. | 34/287 |
| 4,024,648 | A * | 5/1977 | Bender | 34/92 |
| 4,095,012 | A | 6/1978 | Schirmer | |
| 4,180,465 | A | 12/1979 | Murty | |

(Continued)

FOREIGN PATENT DOCUMENTS

| | | |
|---|---|---|
| EP | 0059274 A1 | 9/1982 |
| EP | 0059274 A1 | 9/1982 |

(Continued)

OTHER PUBLICATIONS

Marcus Karel, Daryl B. Lund. Physical Principles of Food Preservation. CRC Press, Jun 1, 2003. p. 529.*

(Continued)

*Primary Examiner* — Adam Marcetich
(74) *Attorney, Agent, or Firm* — Reising Ethington PC

(57) ABSTRACT

A multilayer plastic container for storing lyophilized products includes at least three layers consisting of inner and outer layers having a moisture vapor transmission rate of not more than 0.1 gm mil/100 sq. in.-day at 73° F. and 95% rh, and an intermediate layer of hygroscopic resin construction having a moisture content less than 1000 ppm. The hygroscopic intermediate layer preferably comprises at least 30% of the total thickness of the three layers. The inner and outer layers preferably are of cyclic olefin polymer or cyclic olefin copolymer construction, and the hygroscopic intermediate layer preferably is of amorphous nylon construction. The container preferably is empty and sealed within a secondary container, such as a metallized bag, that is impervious to moisture.

10 Claims, 2 Drawing Sheets

(56) References Cited

U.S. PATENT DOCUMENTS

| | | | | |
|---|---|---|---|---|
| 4,449,632 | A | 5/1984 | Marusiak, Jr. | |
| 4,461,808 | A | 7/1984 | Mollison | |
| 4,535,901 | A | 8/1985 | Okudaira et al. | |
| 4,548,605 | A | 10/1985 | Iwamoto et al. | |
| 4,657,133 | A | 4/1987 | Komatsu et al. | |
| 4,919,984 | A | 4/1990 | Maruhashi et al. | |
| 4,927,010 | A | 5/1990 | Kannankeril | |
| 5,053,259 | A | 10/1991 | Vicik | |
| 5,079,052 | A | 1/1992 | Heyes et al. | |
| 5,084,040 | A * | 1/1992 | Sutter | 604/403 |
| 5,164,258 | A | 11/1992 | Shida et al. | |
| 5,432,234 | A | 7/1995 | Enomoto et al. | |
| 5,491,009 | A | 2/1996 | Bekele | |
| 5,522,155 | A * | 6/1996 | Jones | 34/286 |
| 5,723,189 | A * | 3/1998 | Sudo | 428/36.9 |
| 5,732,837 | A * | 3/1998 | Jones | 215/311 |
| 5,820,956 | A | 10/1998 | Hatakeyama et al. | |
| 6,122,836 | A * | 9/2000 | Tenedini et al. | 34/92 |
| 6,159,656 | A | 12/2000 | Kawabe et al. | |
| 6,247,604 | B1 * | 6/2001 | Taskis et al. | 215/247 |
| 6,503,587 | B2 | 1/2003 | Kashiba et al. | |
| 6,544,610 | B1 | 4/2003 | Minami et al. | |
| 6,572,603 | B1 * | 6/2003 | Tani et al. | 604/403 |
| 6,685,861 | B2 | 2/2004 | Akkapeddi et al. | |
| 6,716,499 | B1 | 4/2004 | Vadhar | |
| 7,281,360 | B1 | 10/2007 | Larimore et al. | |
| 2003/0209453 | A1 | 11/2003 | Herman | |
| 2003/0235664 | A1 | 12/2003 | Merical et al. | |
| 2003/0235667 | A1 | 12/2003 | Darr et al. | |
| 2004/0081588 | A1 * | 4/2004 | Hammerstedt et al. | 422/101 |
| 2004/0081780 | A1 | 4/2004 | Goldman | |
| 2004/0210031 | A1 * | 10/2004 | Itoh et al. | 528/272 |
| 2005/0086830 | A1 * | 4/2005 | Zukor et al. | 34/443 |
| 2006/0198973 | A1 | 9/2006 | Jester | |
| 2006/0229583 | A1 * | 10/2006 | Nagao et al. | 604/403 |
| 2007/0026173 | A1 | 2/2007 | Hussain et al. | |
| 2007/0224587 | A1 * | 9/2007 | Forsell et al. | 435/1.1 |
| 2008/0012172 | A1 * | 1/2008 | Merical et al. | 264/254 |
| 2008/0185301 | A1 * | 8/2008 | Merical et al. | 206/204 |

FOREIGN PATENT DOCUMENTS

| | | |
|---|---|---|
| EP | 0368007 | 5/1990 |
| EP | 2176137 B1 | 12/2011 |
| GB | 1335791 | 10/1973 |

OTHER PUBLICATIONS

"Multilayer Drug Vial Use COC Moisture Barrier," plasticstechnology.com, Mar. 2004, p. 18.

Communication of a Notice of Opposition from EPO Date: Sep. 24, 2012 App. No./ Patent No. 08796918.4-2308 / 2176137 Applicant: Rexam Healthcare Packaging Inc.

* cited by examiner

MULTILAYER PLASTIC CONTAINER AND METHOD OF STORING LYOPHILIZED PRODUCTS

This application is a division of application Ser. No. 11/888,549 filed Aug. 1, 2007.

The present disclosure relates to a multilayer plastic container for storing lyophilized products and to a method of using such a container.

BACKGROUND AND SUMMARY OF THE DISCLOSURE

Lyophilized or freeze-dried products such as medical products typically are stored in Type 1 glass containers or vials, which have very low moisture vapor transmission rates that keep the lyophilized cake intact. Plastic containers, although less expensive and more rugged than glass containers, typically have not been employed for storing lyophilized products because of the higher moisture vapor transmission rates of typical plastic containers. A general object of the present disclosure is to provide a plastic container suitable for long-term storage of lyophilized products, and to provide a method of storing lyophilized products in such a container.

The present disclosure embodies a number of aspects that can be implemented separately from or in combination with each other.

A multilayer plastic container for storing lyophilized products, in accordance with one aspect of the present disclosure, includes at least three layers consisting of inner and outer layers having a moisture vapor transmission rate of not more than 0.1 gm mil/100 sq. in.-day at 73° F. and 95% rh, and an intermediate layer of hygroscopic resin construction having a moisture content less than 1000 ppm. The hygroscopic intermediate layer preferably comprises at least 30% of the total thickness of the three layers. The inner and outer layers preferably are of cyclic olefin polymer or cyclic olefin copolymer construction, and the hygroscopic intermediate layer preferably is of amorphous nylon construction. The container preferably is empty and sealed within a secondary container, such as a metallized bag, that is impervious to moisture.

A method of storing a lyophilized product, in accordance with a second aspect of the present disclosure, includes providing a multilayer plastic container having first and second layers with moisture vapor transmission rates of not more than 0.1 gm mil/100 sq. in.-day at 73° F. and 95% rh, and a third layer between the first and second layers of hygroscopic plastic construction having a moisture content of less than 1000 ppm. The multilayer plastic container is stored in a low humidity environment, such as within a sealed metallized bag. At the time of use, the container is removed from the low humidity environment, a product is placed within the container and the product is lyophilized. The hygroscopic third layer of the container functions as a desiccant to absorb any moisture transmitted through the first and second layers.

BRIEF DESCRIPTION OF THE DRAWINGS

The disclosure, together with additional objects, features, advantages and aspects thereof, will best be understood from the following description, the appended claims and the accompanying drawings in which:

DETAILED DESCRIPTION OF PREFERRED EMBODIMENTS

Figure 1:
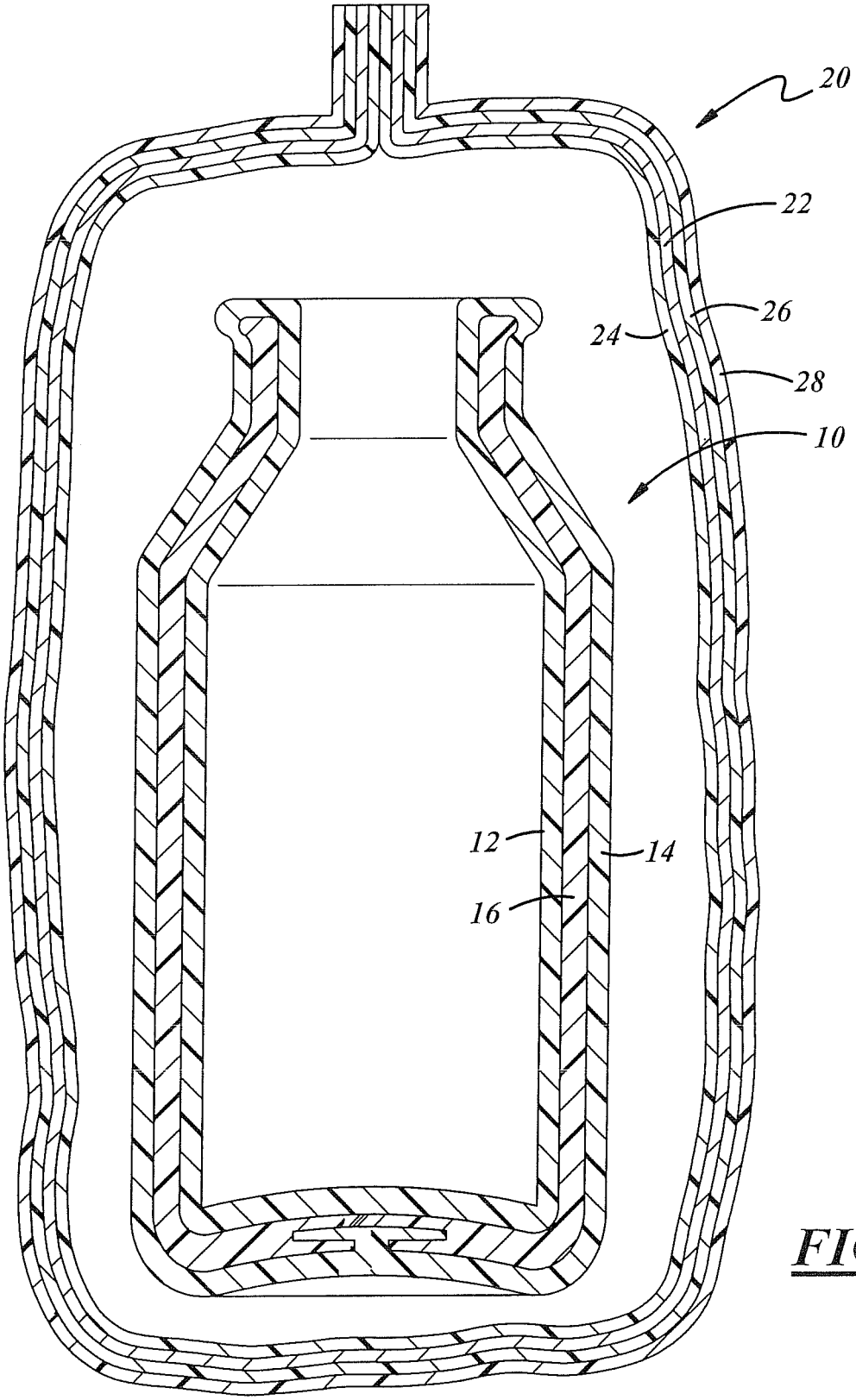
FIG. 1 is a sectioned elevational view of a container for storing lyophilized products in accordance with an exemplary embodiment of the present disclosure.

FIG. 1 illustrates a container 10 in accordance with an exemplary embodiment of the present disclosure. Container 10 is a multilayer plastic container that includes at least inner and outer or first and second plastic layers 12,14 and an intermediate or third plastic layer 16. There can be additional layers inside of inner layer 12, outside of outer layer 14 and/or between layers 12,14. Multilayer container 10 can be fabricated employing any suitable technique, such as injection molding, extrusion blow molding, injection blow molding or reheat blow molding. Inner and outer layers 12,14 preferably have a relatively low moisture vapor transmission rate of not more than 0.1 gm mil/100 sq. in.-day at 73° F. and 95% rh. Intermediate layer 16, preferably is hygroscopic and has a moisture content less than 1000 ppm. Intermediate layer 16 preferably both is hygroscopic and provides a barrier to transmission of gases such as oxygen.

In an exemplary embodiment of the present disclosure, inner and outer layers 12,14 of container 10 are of cyclic olefin polymer construction such as Zeon COP or cyclic olefin copolymer construction such as Ticona COC. Intermediate layer 16 preferably comprises at least 30% of the total thickness of layers 12,14,16, and most preferably is of amorphous nylon construction such as EMS G-21. Amorphous nylon is hygroscopic and provides a barrier to oxygen transmission. As purchased, amorphous nylon typically has a moisture content less than 200 ppm. Further processing prior to container manufacture can reduce this moisture content to less than 50 ppm.

After manufacture, empty container 10 preferably is stored in a low-humidity environment, such as sealed within a secondary container 20 that is impervious to moisture. Secondary container 20 preferably comprises a metallized bag having a metal layer 22 of aluminum for example sandwiched within layers 24,26,28 of plastic construction. A presently preferred secondary container 20 is marketed by Ludlow Coated Products, product FR-2175-B having an outer layer 28 of oriented polypropylene, a layer 26 of polyethylene, a metal foil layer 22 and an inner layer 24 of low density polyethylene. Other metallized bags and secondary containers can be employed.

When ready for use, container 10 is removed from secondary container 20 and the product is placed within the container. The product is lyophilized and the container is sealed. Container layers 12,14 resist transmission of moisture vapor into the container. Hygroscopic intermediate layer 16 resists transmission of oxygen and other gases into the container. Furthermore, the hygroscopic intermediate layer acts as a desiccant to absorb any moisture that is transmitted through layer 14, and indeed draws any moisture remaining within container 10 through layer 12 and absorbs this moisture. Hygroscopic layer 16 thus acts as a scavenger of any moisture that permeates through layer 14, and maintains a low relative humidity across layer 12 reducing the amount of moisture that enters the product and extending the shelf life of the product.

Figure 2:
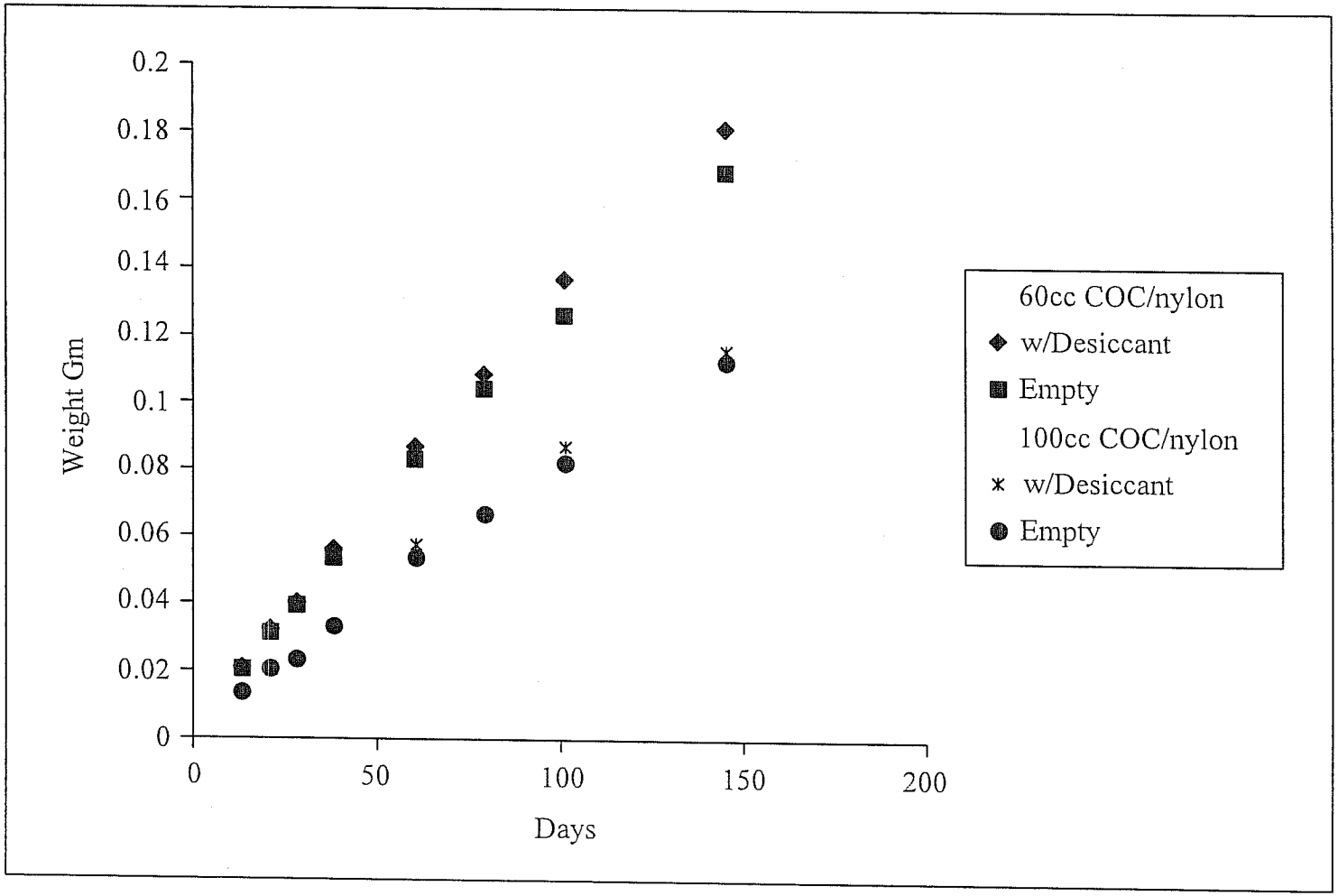
FIG. 2 is a graphic illustration of tests performed on the container of FIG. 1.

FIG. 2 illustrates results of tests performed on a 60 cc container 10 and a 100 cc container 10. In each container, layers 12,14 were of Ticona cyclic olefin copolymer construction and intermediate layer 16 was of EMS G-21 amorphous nylon construction. In each container, intermediate layer 16 constituted about 30% of the total sidewall thickness. Sealed containers with and without desiccant were placed in a test chamber at 75% relative humidity and 23° C. FIG. 2 demonstrates that, after up to 150 days, there was no significant weight gain difference between the containers filled with desiccant and the empty containers.

There thus has been disclosed a multilayer plastic container and a method of use for storing lyophilized products that fully achieve all of the objects and aims previously set forth. The disclosure has been presented in conjunction with an exemplary embodiment, and modifications and variations have been discussed. Other modifications and variations readily will suggest themselves to persons of ordinary skill in the art in view of the foregoing discussion. The disclosure is intended to encompass all such modifications and variations as fall within the spirit and broad scope of the appended claims.

The invention claimed is:

1. A method of storing a lyophilized product, which includes the steps of:

(a) providing a multilayer plastic container that includes first and second plastic layers having a moisture vapor transmission rate of not more than 0.1 gm mil/100 sq. in.-day at 73° F. and 95% rh, and a third plastic layer between said first and second layers, wherein said third plastic layer is of hygroscopic plastic construction and has a moisture content less than 1000 ppm, (b) storing said plastic container in a low humidity environment by sealing said container in a secondary container that is impervious to moisture until said container is ready for use, (c) removing said plastic container from said low humidity environment by removing said plastic container from said secondary container, (d) after said step (c), placing a product within said plastic container, (e) after said step (d), lyophilizing said product within said plastic container, (f) after said step (e), sealing said product within said plastic container; and then (g) after completion of said step (f), storing said product within said plastic container, such that said hygroscopic third layer functions as a desiccant and absorbs any moisture transmitted through said first and second layers to reduce the amount of moisture that would otherwise enter said product during storage.

2. The method set forth in claim 1 wherein said step (b) is carried out by placing said plastic container in a metalized bag.

3. The method set forth in claim 2 wherein said hygroscopic third layer comprises at least 30% of the total thickness of said first, second and third layers.

4. The method set forth in claim 3 wherein said first and second layers are of cyclic olefin polymer or cyclic olefin copolymer construction and said third layer is of amorphous nylon construction.

5. The method set forth in claim 4 wherein said amorphous nylon third layer has a moisture content less than 200 ppm following said step (a).

6. The method set forth in claim 5 wherein said amorphous nylon third layer has a moisture content less than 50 ppm following said step (a).

7. The method set forth in claim 1 wherein said first and second plastic layers include inner and outer layers of said multilayer plastic container.

8. The method set forth in claim 7 wherein said step (g) further includes: storing said product within said plastic container such that said hygroscopic third layer draws any remaining moisture within said plastic container after said step (f) through said inner layer and absorbs said remaining moisture.

9. The method set forth in claim 7 wherein said step (g) further includes:

storing said product within said plastic container such that said hygroscopic third layer maintains a low relative humidity across said inner layer.

10. A container produced by the method set forth in claim 1.

* * * * *